US009163350B2

(12) United States Patent
Moon et al.

(10) Patent No.: US 9,163,350 B2
(45) Date of Patent: Oct. 20, 2015

(54) CLOTHES TREATING APPARATUS AND CONTROLLING METHOD THEREOF

(75) Inventors: Jung Wook Moon, Changwon-si (KR); Dae Yun Park, Changwon-si (KR); Sog Kie Hong, Changwon-si (KR); Jong Seok Kim, Changwon-si (KR); Seung Gyu Ryu, Changwon-si (KR); Hye Yong Park, Changwon-si (KR); Chang Gyu Choi, Changwon-si (KR); Dong Won Kim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1230 days.

(21) Appl. No.: 12/733,004

(22) PCT Filed: Aug. 4, 2008

(86) PCT No.: PCT/KR2008/004511

§ 371 (c)(1),
(2), (4) Date: Feb. 2, 2010

(87) PCT Pub. No.: WO2009/020320

PCT Pub. Date: Feb. 12, 2009

(65) Prior Publication Data

US 2010/0132129 A1 Jun. 3, 2010

(30) Foreign Application Priority Data

Aug. 3, 2007 (KR) ..... 10-2007-0078117

(51) Int. Cl.
*D06F 37/00* (2006.01)
*D06F 39/04* (2006.01)

(Continued)

(52) U.S. Cl.
CPC ..... *D06F 39/045* (2013.01); *D06F 39/008* (2013.01); *D06F 58/10* (2013.01);

(Continued)

(58) Field of Classification Search
CPC ..... D06F 2058/2858; D06F 2058/287; D06F 2058/289; D06F 2232/10; D06F 39/008; D06F 39/045; D06F 58/10; D06F 58/206; D06F 58/26
USPC ..... 8/147–148, 149.3; 34/487, 494, 411; 68/12.03, 5 C
See application file for complete search history.

(56) References Cited

U.S. PATENT DOCUMENTS 7,681,418 B2 * 3/2010 Wong et al. ..... 68/5 C
2005/0066538 A1 * 3/2005 Goldberg et al. ..... 34/218

(Continued)

FOREIGN PATENT DOCUMENTS

CN 1170061 A 1/1998
CN 2492229 Y 5/2002

(Continued)

*Primary Examiner* — Michael Barr
*Assistant Examiner* — Kevin G Lee
(74) *Attorney, Agent, or Firm* — Dentons US LLP

(57) ABSTRACT

A clothes treating apparatus and a controlling method thereof are disclosed. The clothes treating apparatus includes a housing defining a accommodating space for receiving clothes, an air supplying device for drying air circulating into the accommodating space, a temperature measuring device for measuring the interior temperature of the accommodating space, a preheating unit for raising the temperature of the accommodating space according to the temperature measured by the temperature measuring device, and a controller for controlling the air supplying device and the preheating unit according to the temperature measured by the temperature measuring device.

7 Claims, 2 Drawing Sheets

(51) Int. Cl.

| | |
|---|---|
| ***D06F 39/00*** | (2006.01) |
| ***D06F 58/10*** | (2006.01) |
| *D06F 58/28* | (2006.01) |

(52) U.S. Cl.

CPC ..... *D06F2058/287* (2013.01); *D06F 2058/289* (2013.01); *D06F 2058/2829* (2013.01); *D06F 2058/2858* (2013.01)

(56) References Cited

U.S. PATENT DOCUMENTS

| | | | | |
|---|---|---|---|---|
| 2006/0080974 | A1 | 4/2006 | Ono et al. | |
| 2006/0179676 | A1 * | 8/2006 | Goldberg et al. | 34/77 |
| 2007/0118996 | A1 | 5/2007 | Mills et al. | |

FOREIGN PATENT DOCUMENTS

| | | | |
|---|---|---|---|
| CN | 1611659 | | 5/2005 |
| CN | 1763294 | A | 4/2006 |
| EP | 1 650 343 | A1 | 4/2006 |
| GB | 2 238 322 | | 5/1991 |
| JP | 8-168596 | A | 7/1996 |
| JP | 10-235091 | A | 9/1998 |
| JP | 2001-198396 | A | 7/2001 |
| KR | 10-2007-0023887 | A | 3/2007 |
| KR | 10-2007-0023891 | A | 3/2007 |
| WO | WO 2006101365 | A1 * | 9/2006 |
| WO | WO 2007/024050 | A1 | 3/2007 |
| WO | WO 2007081069 | A1 * | 7/2007 |

* cited by examiner

CLOTHES TREATING APPARATUS AND CONTROLLING METHOD THEREOF

This application claims the benefit of Korean Patent Application No. 10-2007-0078117 filed on Aug. 3, 2007 and PCT Application No. PCT/KR2008/004511, filed on Aug. 4, 2008, which is hereby incorporated by reference for all purposes as if fully set forth herein.

TECHNICAL FIELD

The present invention relates to a clothes treating apparatus and a controlling method thereof, and more particularly, to a clothes treating apparatus and a controlling method thereof that are capable of more effectively refreshing clothes.

BACKGROUND ART

In recent years, there have been used various kinds of clothes treating apparatus together with washing machines that wash clothes. For example, a drum type drying machine that dries washed clothes, a housing type drying machine that dries clothes while suspending the clothes, and a refresher that supplied dry air to clothes to refresh the clothes have been developed.

Among the clothes treating apparatuses, the refresher or the drying machine mainly heats air through the use of a heater and supplies the heated air to clothes. The heater may be classified as a gas heater that burns gas to heat air or an electric heater that heats air using electric resistance. In recent years, the electric heater has been widely used because the installation of the electric heater is convenient and the structure of the electric heater is simple.

However, when air is heated by the electric heater, high-temperature heat generated from the heater may be directly transmitted to clothes, with the result that the clothes may be damaged, and, furthermore, the interior of the clothes treating apparatus may be destroyed by fire.

Also, since the electric heater uses electricity to heat air, the electricity is excessively consumed to heat the air to a desired temperature, with the result that the maintenance costs of the electric heater are greatly increased.

DISCLOSURE OF INVENTION

Technical Problem

An object of the present invention devised to solve the problem lies on a clothes treating apparatus of which the structure is simple and which is capable of redwing the consumption of electrical energy.

Another object of the present invention devised to solve the problem lies on a controlling method of a clothes treating apparatus that is capable of preventing the damage of clothes at the beginning of the operation of the clothes treating apparatus.

Technical Solution

The object of the present invention can be achieved by providing a clothes treating apparatus including a housing defining a accommodating space for receiving clothes, an air supplying device for drying air circulating into the accommodating space, a temperature measuring device for measuring the interior temperature of the accommodating space, a preheating unit for raising the temperature of the accommodating space according to the temperature measured by the temperature measuring device, and a controller for controlling the air supplying device and the preheating unit according to the temperature measured by the temperature measuring device.

Preferably, the clothes treating apparatus further includes a steam generator for generating steam to be supplied into the accommodating space, and the preheating unit is implemented by the steam generator.

Preferably, the clothes treating apparatus further includes a circulation duct communicating with the accommodating space, and the air supplying device is mounted along the circulation duct. In this case, the temperature measuring device may be mounted at the rear end of the air supplying device along the circulation duct for measuring the temperature of air supplied from the air supplying device to the accommodating space. Alternatively, the temperature measuring device may be mounted at the front end of the air supplying device along the circulation duct for measuring the temperature of air introduced from the accommodating space to the air supplying device.

Preferably, when the temperature measured by the temperature measuring device is equal to or less than a predetermined reference temperature, the controller raises the temperature of the accommodating space, such that the temperature of the accommodating space exceeds the reference temperature, and drives the air supplying device. In this case, the controller may spray steam into the accommodating space for a predetermined time through the steam generator to raise the temperature of the accommodating space. Also, the controller may turn off the steam generator a predetermined time before the temperature of the accommodating space reaches the reference temperature or at a predetermined temperature before the temperature of the accommodating space reaches the reference temperature.

Preferably, the amount of water supplied into the steam generator to supply steam from the steam generator into the accommodating space is different from the amount of water supplied to treat clothes by the steam generator.

In another aspect of the present invention, provided herein is a controlling method of a circulation type clothes treating apparatus including an air supplying device for drying air circulating into a accommodating space, the controlling method including (a) measuring the interior temperature of the accommodating space, (b) raising the temperature of the accommodating space according to the measured temperature, and (c) driving the air supplying device to supply dry air into the accommodating space.

Preferably, when the temperature measured at the step (a) is equal to or less than a predetermined reference temperature, the step (b) is carried out.

Preferably, the clothes treating apparatus further includes a steam generator for generating steam to be supplied into the accommodating space, and the step (b) includes supplying the steam into the accommodating space to raise the temperature of the accommodating space.

Preferably, the step (b) includes (b1) supplying water to the steam generator and (b2) generating steam by the steam generator and supplying the steam into the accommodating space for a predetermined time.

Preferably, the amount of water supplied at the step (b1) is different from the amount of water supplied to treat clothes.

Preferably, the step (a) includes detecting the temperature of the circulating air at the front end or the rear end of the air supplying device.

Preferably, after the completion of the step (b), the step (a) and the step (b) are repeatedly carried out a predetermined number of times. In this case, the controlling method may further include, when the temperature of the accommodating space does not exceed a predetermined reference temperature even after the step (a) and the step (b) are repeatedly carried out the predetermined number of times, informing a user that the temperature of the accommodating space does not exceed the predetermined reference temperature.

Preferably, the step (b) includes turning off the steam generator a predetermined time before the temperature of the accommodating space reaches the predetermined reference temperature or at a predetermined temperature before the temperature of the accommodating space reaches the reference temperature.

Advantageous Effects

As apparent from the above description, the clothes treating apparatus according to the present invention includes the heat pump, and therefore, it is possible to refresh clothes while considerably reducing energy consumption as compared to the conventional art.

Also, according to the present invention, it is possible to provide a clothes treating apparatus that is normally driven at a low-temperature area.

Also, according to the present invention, the interior temperature of the clothes treating apparatus is raised before dry air is supplied by the heat pump. Consequently, it is possible to prevent the damage to the clothes treating apparatus and the malfunction of the clothes treating apparatus.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings.

Figure 1:
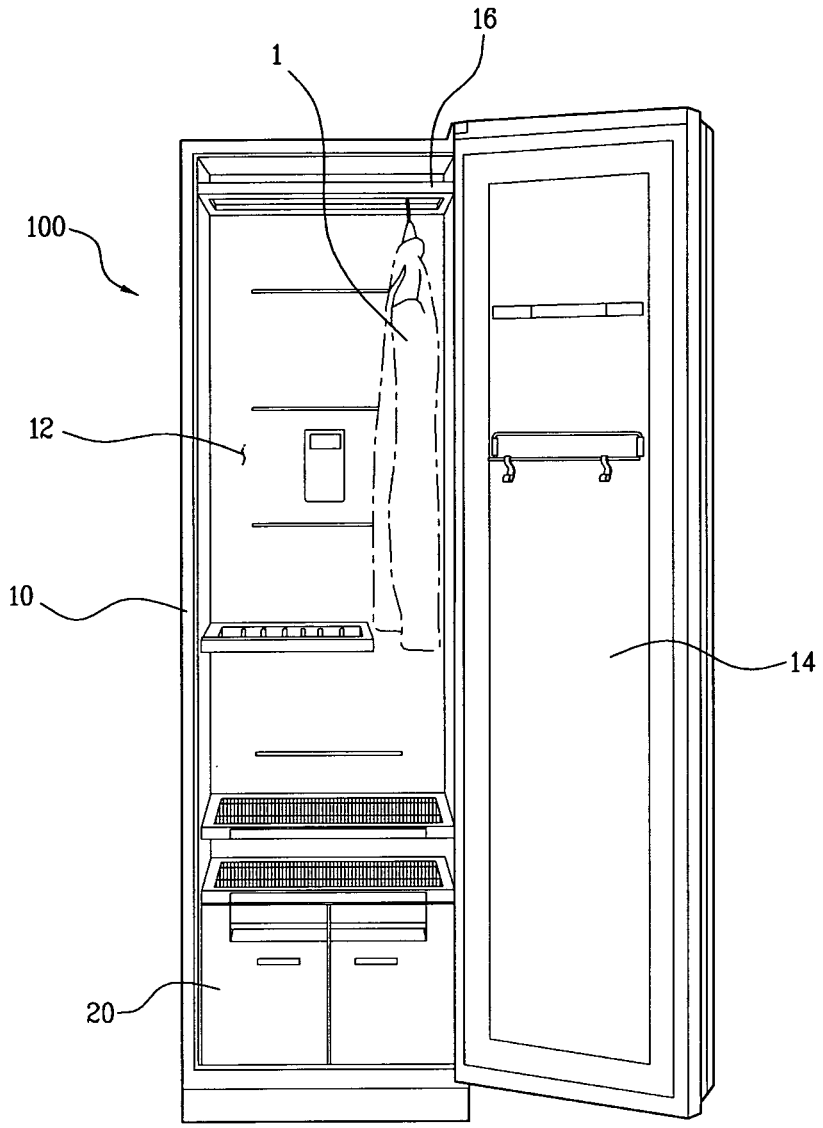
FIG. 1 is a front view illustrating a clothes treating apparatus according to an embodiment of the present invention.

FIG. 1 is a front view illustrating a clothes treating apparatus according to an embodiment of the present invention. In this specification, a refresher that refreshes clothes is described as an example of the clothes treating apparatus; however, the clothes treating apparatus according to the present invention is not limited to the refresher, and therefore, the idea of the present invention may be applied to other clothes treating apparatuses with a heat pump, which will be described in the following. Hereinafter, the structure of the clothes treating apparatus according to the present invention will be first discussed, and then a controlling method of the clothes treating apparatus will be discussed.

Referring to FIG. 1, the clothes treating apparatus 100 according to the present invention includes a housing defining a accommodating space 12 for receiving clothes 1, an air supplying device 22 (see FIG. 2) for supplying dry air into the accommodating space 12, a temperature measuring device 50 (see FIG. 2) for detecting the temperature of the accommodating space 12 in the housing 10, a preheating unit for raising the temperature of the accommodating space 12 according to the temperature detected by the temperature measuring device 50, and a controller (not shown) for controlling the air supplying device 22 and the preheating unit according to the temperature detected by the temperature measuring device 50. The respective components of the clothes treating apparatus will be described in detail with reference to the accompanying drawings.

In the housing 10 are mounted various components, which will be described in the following. The accommodating space 12 is defined in the housing 10 for receiving clothes. The accommodating space 12 selectively communicates with the outside by a door 14. Also, various support members 16, on which the clothes 1 are hung, are mounted in the accommodating space 12. The structure for supporting the clothes 1 is widely known in the art to which the present invention pertains, and therefore, a detailed description thereof will not be given.

Meanwhile, a machinery room 20 is defined in the housing 10. In the machinery room 20 are mounted a steam generator 30, as the preheating unit, for selectively supplying steam, as well as the air supplying device 22 for supplying dry air into the accommodating space 12. Preferably, the machinery room 20 is located below the accommodating space 12. The air supplying device 22 and the steam generator 30 are located in the machinery room 20. The reason why the machinery room 20 is located below the accommodating space 12 is that dry air and steam supplied into the accommodating space 12 have a rising property, and therefore, it is preferred for the machinery room 20 to be located below the accommodating space 12 to supply the dry air and the steam upward.

Figure 2:
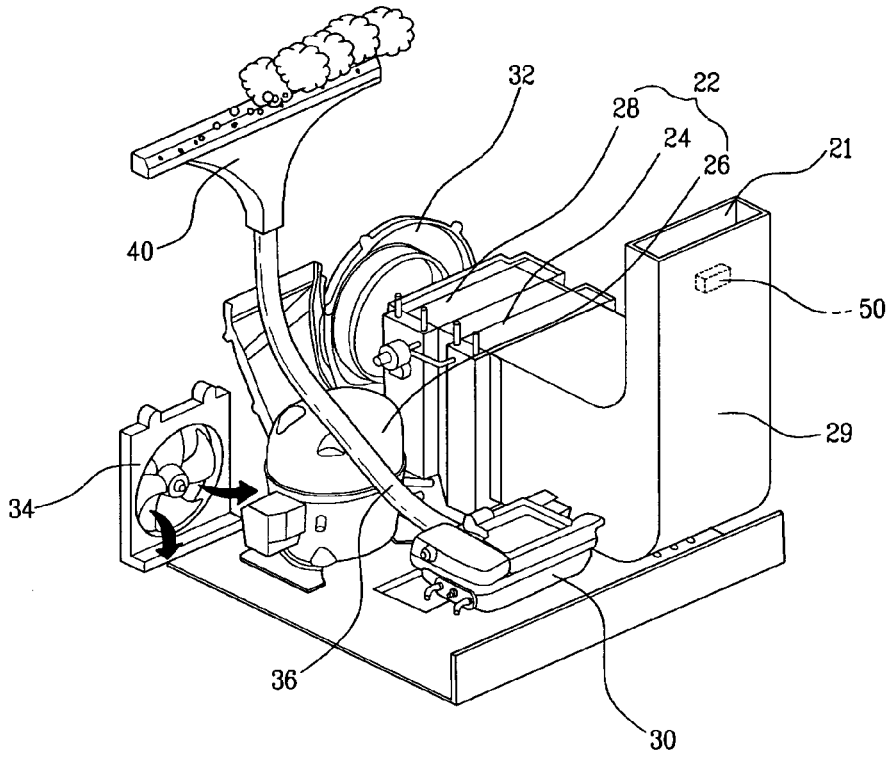
FIG. 2 is a perspective view illustrating the interior of a machinery room of FIGS. 1.

FIG. 2 is a perspective view schematically illustrating the interior structure of the machinery room 20. For convenience of description, only structural elements of the air supplying device 22 and the steam generator 30 are shown in FIG. 2, but pipe lines for connecting the structural elements of the air supplying device 22 and the steam generator 30 are omitted from FIG. 2.

Referring to FIG. 2, the air supplying device 22, which supplies dry air into the accommodating space 12 (see FIG. 1), and the steam generator 30, which supplies steam, are located in the machinery room 20.

In this embodiment, a heat pump, adopted as the air supplying device for supplying dry air, is similar to a heat pump used in an air conditioner. That is, the heat pump 22 includes an evaporator 24, a compressor 26, a condenser 28, and an expansion valve (not shown), through all of which a refrigerant circulates to dehumidify and heat air. Specifically, the refrigerant is evaporated by the evaporator 24, with the result that the refrigerant absorbs latent heat from surrounding air. Consequently, the air is cooled, and moisture contained in the air is condensed and removed. Also, when the refrigerant passes through the compressor 26 and is condensed by the condenser 28, the refrigerant transmits latent heat to surrounding air, with the result that the surrounding air is heated. Consequently, the evaporator 24 and the condenser 28 function as a heat exchanger, with the result that air introduced into the machinery room 20 is dehumidified and heated, while passing through the evaporator 24 and the condenser 28, and the dehumidified and heated air is supplied into the accommodating space 12.

When the heat pump 22 is used as described above, it is possible to not only heat air but also dehumidify the air without using an additional dehumidifier. Consequently, the air resupplied into the accommodating space 12 by the heat pump 22 is heated and dehumidified without using the additional dehumidifier, and therefore, it is possible to easily dry and refresh clothes.

Specifically, an air inlet port 21, through which air is introduced into the machinery room 20, is formed at the front upper part of the machinery room 20. Preferably, the air inlet port 21, the evaporator 24, the condenser 28, and a fan 32 are connected via a circulation duct 29, which defines an air flow channel. Air, introduced into the machinery room 20 along the circulation duct 29 through the air inlet port 21, is dehumidified and heated, while passing through the air supplying device 22, and is then supplied into the accommodating space 12 by the fan 32.

Although not shown, a filter may be mounted in the air inlet port 21. When the filter is mounted in the air inlet port 21, it is possible to filter out various foreign matters from air introduced into the machinery room 20 such that only fresh air can be supplied into the accommodating space 12.

Meanwhile, the steam generator 30 is mounted in the machinery room 20 for selectively supplying steam into the accommodating space 12. As the steam is supplied into the accommodating space 12 by the steam generator 30, it is possible to remove wrinkles from clothes in the accommodating space 12. In addition, the sanitizing effect by the high-temperature steam and the refresh effect by the swelling of the clothes may be expected. The timing when the steam is sprayed by the steam generator 30 may be appropriately changed. It is preferred for the steam generator 30 to spray the steam before dry air is supplied by the air supplying device 22. This is because the supply of the dry air to dry the clothes after the spray of the high-temperature steam is preferred.

In the steam generator 30 is mounted a heater (not shown) for heating water in the steam generator 30. The heater heats the water to generate steam, which is supplied into the accommodating space 12. An external faucet or a container provided at one side of the machinery room 20 may be used as a water supply source for supplying water into the steam generator 30. Preferably, the container is detachably mounted in the machinery room 20 such that a user can separate the container from the machinery room 20, fill the container with water, and mount the container in the machinery room 20. Also, the steam generated by the steam generator 30 is supplied into the accommodating space 12 through a steam hose 36 and a steam nozzle 40. In this case, it is preferred to shorten the steam hose 36 to prevent the temperature of the steam from lowering or from condensing during the flow of the steam through the steam hose 36. Consequently, when the machinery room 20 is located below the accommodating space 12, it is preferred for the steam nozzle 40 to supply the steam through the top of the machinery room 20, i.e., the bottom of the accommodating space 12.

Also, a circulation fan 34 may be mounted at the rear of the machinery room 20. The circulation fan 34 supplies air outside the machinery room 20 into the machinery room 20 to prevent the interior temperature of the machinery room 20 from excessively rising due to the operation of the air supplying device 22 and the steam generator 30.

In the clothes treating apparatus with the above-stated construction, however, when the temperature of the circumference where the clothes treating apparatus is located falls down below a reference temperature, the air supplying device 22 may not be normally driven.

Specifically, when the temperature of the circumference where the clothes treating apparatus 100 is located falls down below a reference temperature, e.g., 5° C., the temperature of air introduced into the heat pump, corresponding to the air supplying device 22 in this embodiment, falls down below 5° C. at the beginning of the operation of the heat pump.

Consequently, the temperature of air introduced into the evaporator 24 of the heat pump 22 lowers, with the result that the refrigerant may not be completely evaporated but some of the refrigerant may be supplied into the compressor 26 in a liquid state, and therefore, the compressor 26 may be damaged or may break due to the liquid compression. Also, as the surrounding temperature of the compressor 26 lowers, an oil foaming phenomenon, in which foam is produced in the oil of the compressor 26, occurs, with the result that the life span of the compressor 26 is shortened. Furthermore, as the refrigerant is not completely evaporated by the evaporator 24, the amount of latent heat contained in the refrigerant decreases. As a result, when the refrigerant is condensed by the condenser 28, and air is heated by latent heat, the air may not be satisfactorily heated.

Consequently, when, at the beginning of the operation of the heat pump 22, the temperature of the accommodating space 12 of the clothes treating apparatus 100, more specifically the temperature of air introduced into the heat pump 22 or the temperature of air supplied from the heat pump 22 into the accommodating space 12, is lower than the reference temperature, it is necessary to raise the temperature of the air before the air is introduced into the heat pump 22.

In this case, an additional preheating unit may be provided for raising the temperature of the accommodating space 12 before the operation of the heat pump 22. In the clothes treating apparatus according to this embodiment, however, the steam generator 30 for supplying steam to refresh the clothes is provided to raise the temperature of the accommodating space 12. That is, in the clothes treating apparatus according to this embodiment, the steam generator 30 is used as the preheating unit for raising the temperature of the accommodating space 12 before the operation of the heat pump 22, which will be described hereinafter in detail.

In order to meet the above requirements, the clothes treating apparatus 100 according to this embodiment includes the temperature measuring device 50 for detecting the temperature of the accommodating space 12 in the housing 10, more specifically the temperature of air introduced into the heat pump 22 or the temperature of air supplied from the heat pump 22 into the accommodating space 12. The operation of the heat pump 22 and the steam generator 30 is controlled based on the temperature detected by the temperature measuring device 50.

Specifically, the temperature measuring device 50 may be mounted along the circulation duct 29. That is, the temperature measuring device 50 is preferably located at the front part of the heat pump 22, i.e., the front end of the evaporator 24, or the rear part of the heat pump 22, i.e., the rear end of the condenser 28, to detect the temperature of air introduced from the accommodating space 12 into the heat pump 22 or the temperature of air supplied from the heat pump 22 into the accommodating space 12. When the air flow channel is defined by the circulation duct 29, as previously described, the temperature measuring device 50 may be located in the circulation duct 29 at the front end of the evaporator 24 or in the circulation duct 29 at the rear end of the condenser 28. Alternatively, it is possible for the temperature measuring device 50 to be located adjacent to the air inlet port 21, through which air is introduced into the machinery room 20, or an air outlet port (not shown), through which air is discharged into the accommodating space 12. That is, it is possible for the temperature measuring device 50 to be located at any positions so long as the temperature measuring device 50 can detect the temperature of the air introduced into the heat pump 22 or discharged from the heat pump 22.

Meanwhile, the temperature measuring device 50 detects the temperature of air introduced into the heat pump 22 or discharged from the heat pump 22 and transmits the detected temperature to the controller (not shown). The controller compares the detected temperature with a predetermined reference temperature, for example 5° C. When the temperature of the air introduced into the heat pump 22 or discharged from the heat pump 22 is equal to or less than 5° C., the controller performs a controlling operation to raise the temperature of the air in the accommodating space 12 of the housing 10.

Specifically, when the temperature of the air introduced into the heat pump 22 or discharged from the heat pump 22 is equal to or less than 5° C., the controller controls the steam generator 30 to be driven before the operation of the heat pump 22. That is, the steam generator 30 is driven to generate steam, and the generated steam is supplied into the accommodating space 12. As the high-temperature steam is supplied into the accommodating space, the temperature of the air in the accommodating space rises.

Meanwhile, the amount of water supplied into the steam generator 30 when the steam generator 30 is driven as the preheating unit for raising the temperature of the accommodating space 12 may be different from the amount of water supplied to treat clothes.

That is, when steam is supplied to remove smells from the clothes or to preform a refreshing process for removing wrinkles from the clothes, it is necessary to supply a relatively large amount of steam although the amount of the steam may be changed depending upon the amount of clothes. However, when the steam generator 30 is driven as the preheating unit, only the temperature of the accommodating space 12 is raised. Consequently, the amount of water supplied into the steam generator 30 when the steam generator 30 is driven as the preheating unit is different from the amount of water supplied into the steam generator 30 to perform the refreshing process. Specifically, the amount of water supplied into the steam generator 30 when the steam generator 30 is driven as the preheating unit is less than the amount of water supplied into the steam generator 30 to perform the refreshing process.

Meanwhile, when the steam is supplied as described above, the temperature of the air introduced from the accommodating space into the heat pump 22 through the air inlet port 21 rises. After the steam is supplied by the steam generator 30 for a predetermined time, the controller detects the temperature of the air introduced into the heat pump 22 through the temperature measuring device 50. When the detected temperature exceeds the reference temperature, e.g., 5° C., the heat pump 22 is driven to dehumidify and heat the air. On the other hand, when the detected temperature is equal to or less than the reference temperature, e.g., 5° C., a steam spraying process is performed.

Meanwhile, when the steam is supplied by the steam generator 30, the steam may be continuously supplied until the temperature of the accommodating space 12 reaches a predetermined reference temperature. However, when the steam is continuously supplied, the temperature of the accommodating space 12 excessively exceeds the reference temperature, with the result that energy is wasted.

Consequently, when the steam is supplied, the controller according to the present invention controls the steam to be supplied for a predetermined time, e.g., for 2 to 5 minutes. After the supply of the steam, the temperature of the accommodating space 12 is measured. When the measured temperature is equal to or less than 5° C., the steam spraying process is performed again.

Also, when the steam is supplied, the controller may measure the temperature of the accommodating space 12 continuously or periodically and may turn off the steam generator a predetermined time, e.g., 10 seconds to 1 minute, before the temperature of the accommodating space 12 reaches the predetermined reference temperature. Alternatively, the controller may control the steam generator to be turned off when the temperature of the accommodating space 12 reaches a predetermined temperature, e.g., 0 to 3° C., before the temperature of the accommodating space 12 reaches the predetermined reference temperature, e.g., 5° C.

In this way, the controller controls the off time of the steam generator to prevent the temperature of the accommodating space 12 from excessively rising and thus reduce energy consumption.

Figure 3:
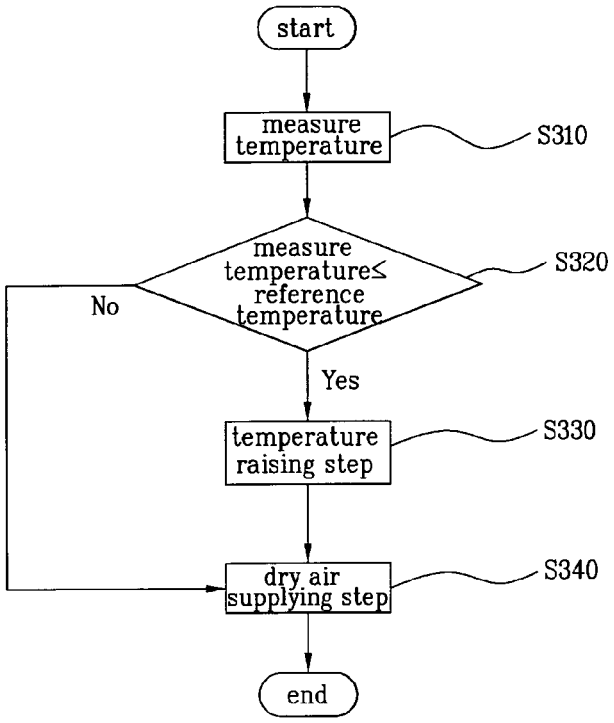
FIG. 3 is a flow chart illustrating a controlling method of a clothes treating apparatus according to an embodiment of the present invention.

FIG. 3 is a flow chart illustrating a controlling method of the clothes treating apparatus, which is performed by the controller.

Referring to FIG. 3, the controlling method according to the present invention includes a step of measuring temperature S310, a step of comparing the measured temperature with a reference temperature S320, a step of raising the temperature of air S330, and a step of supplying dry air S340.

First, when the clothes treating apparatus 100 is driven, the controller measures the temperature of air (S310). Here, the controller measures the temperature of air introduced into the heat pump 22 or discharged from the heat pump 22 using the temperature measuring device 50.

Subsequently, the controller compares the detected result, i.e., the measured temperature of the air with the predetermined reference temperature (S320). Here, the reference temperature is not particularly restricted. For example, the reference temperature may be set to be 5° C.

When the measured temperature exceeds the reference temperature, the controller determines that the temperature of the air introduced into the heat pump 22 of the clothes treating apparatus 100 is appropriate and directly drives the heat pump 22 to supply dry air into the accommodating space 12.

On the other hand, when the measured temperature is equal to or less than the reference temperature, the controller determines that the temperature of the air introduced into the heat pump 22 is low and raises the temperature of the air (S330). The step of raising the temperature of the air may include a process for spraying high-temperature steam by the steam generator 30 as previously described.

When the steam is supplied, the controller may control the steam generator to be turned off after the steam is supplied for a predetermined time, e.g., 2 to 5 minutes, a predetermined time before the measured temperature reaches a predetermined reference temperature, or at a temperature below a predetermined temperature before the temperature of the accommodating space 12 reaches the predetermine reference temperature.

When the temperature of the air rises through the steam spraying process, the controller drives the heat pump 22 to supply dry air into the accommodating space 12.

Meanwhile, although not shown, the controlling method may further include a step of measuring the temperature of the air again, which is carried out after the step of raising the temperature of the air (S330). That is, after the steam is sprayed, the temperature of the air is measured again, and, when the measured temperature exceeds the reference temperature, the heat pump 22 is controlled to be driven.

Meanwhile, when the temperature of the accommodating space 12 does not exceed the predetermined reference temperature although the step of raising the temperature of the receiving is repeatedly carried out a predetermined number of times since the measured temperature is equal to or less than the predetermined reference temperature, which means that the clothes treating apparatus is abnormal or the surrounding temperature is too low, the controlling method may further include a step of informing a user that the temperature of the accommodating space 12 does not exceed the predetermined reference temperature.

The invention claimed is:

1. A controlling method of a circulation type clothes treating apparatus including an air supplying device for drying air circulating into an accommodating space and a steam generator for generating steam to be supplied into the accommodating space, the controlling method comprising:

(a) measuring an interior temperature of the accommodating space;

(b) raising the temperature of the accommodating space to prevent malfunction and/or damage to the clothes treating apparatus according to the measured interior temperature, wherein the step (b) includes supplying the steam into the accommodating space to raise the temperature of the accommodating space; and (c) driving the air supplying device to supply dry air into the accommodating space, wherein step (b) does not start without performing step (a), wherein step (b) is performed when the temperature measured at the step (a) is less than or equal to a predetermined reference temperature, wherein step (b) is not performed when the temperature measured at the step (a) is more than the predetermined reference temperature, and wherein the predetermined reference temperature is a minimum temperature to prevent malfunction and/or damage to the clothes treating apparatus.

2. The controlling method according to claim 1, wherein the step (b) comprises:

(b1) supplying water to the steam generator; and (b2) generating steam by the steam generator and supplying the steam into the accommodating space for a predetermined time.

3. The controlling method according to claim 2, wherein an amount of water supplied at the step (b1) is different from the amount of water supplied to treat clothes.

4. The controlling method according to claim 1, wherein the step (a) includes measuring a temperature of the circulating air in front of or behind the air supplying device.

5. The controlling method according to claim 1, wherein, after the completion of the step (b), the step (a) and the step (b) are repeatedly performed a predetermined number of times.

6. The controlling method according to claim 5, further comprising:

informing a user that the temperature of the accommodating space does not exceed the predetermined reference temperature when the temperature of the accommodating space does not exceed a predetermined reference temperature even after the step (a) and the step (b) are repeatedly performed the predetermined number of times.

7. The controlling method according to claim 2, wherein the step (b2) includes turning off the steam generator at a predetermined time before the temperature of the accommodating space reaches the predetermined reference temperature or at a predetermined temperature before the temperature of the accommodating space reaches the reference temperature.

* * * * *